United States Patent [19]

Scheler

[11] Patent Number: 4,590,143

[45] Date of Patent: May 20, 1986

[54] TWO-COMPONENT DIAZOTYPE MATERIAL WITH DIAZONIUM SALT WITH ANION OF BENZENE OR TOLUENE SULFONATE

[75] Inventor: Siegfried Scheler, Wiesbaden, Fed. Rep. of Germany

[73] Assignee: Hoechst Aktiengesellschaft, Frankfurt am Main, Fed. Rep. of Germany

[21] Appl. No.: 584,546

[22] Filed: Feb. 28, 1984

[30] Foreign Application Priority Data

Mar. 9, 1983 [DE] Fed. Rep. of Germany ..... 3308395

[51] Int. Cl.[4] ..... G03C 1/54; G03C 1/78

[52] U.S. Cl. ..... 430/163; 430/146; 430/157; 430/171; 430/176; 430/186

[58] Field of Search ..... 430/163, 171, 186, 146, 430/157, 176

[56] References Cited

U.S. PATENT DOCUMENTS

| | | | |
|---|---|---|---|
| 2,809,189 | 10/1957 | Stanley | 260/141 |
| 3,039,872 | 6/1962 | de Boer et al. | 430/176 |
| 3,153,592 | 10/1964 | Klimkowski et al. | 430/171 |
| 3,219,447 | 11/1965 | Neugebauer et al. | 430/171 |
| 3,522,048 | 7/1970 | Welch | 430/151 |
| 3,719,491 | 3/1973 | Mizianty | 430/186 |

FOREIGN PATENT DOCUMENTS

| | | | |
|---|---|---|---|
| 156740 | 9/1982 | German Democratic Rep. | 430/189 |

OTHER PUBLICATIONS

Dinaburg, M. S., "Photosensitive Diazo Cpds", The Focal Press, 1964, pp. 92, 93 and 115.

*Primary Examiner*—Charles L. Bowers, Jr.
*Attorney, Agent, or Firm*—Schwartz, Jeffery, Schwaab, Mack, Blumenthal & Evans

[57] ABSTRACT

Disclosed is a two-component diazotype material comprising a support and a light-sensitive layer containing (a) at least one diazonium compound derived from p-phenylenediamine and carrying a basic heterocyclic radical in the 4-position and ether groups in the 2- and 5-positions, (b) a coupler component, and (c) an acid stabilizer, the diazonium compound being present in the form of a benzenesulfonate or toluenesulfonate. The disclosed materials have a good storability and are easily developed.

10 Claims, No Drawings

TWO-COMPONENT DIAZOTYPE MATERIAL WITH DIAZONIUM SALT WITH ANION OF BENZENE OR TOLUENE SULFONATE

BACKGROUND OF THE INVENTION

The present invention relates to a two-component diazotype material comprising a support and a light-sensitive layer which comprises at least one diazonium compound which is derived from p-phenylenediamine and which carries a basic heterocyclic radical in the 4-position and ether groups in the 2- and 5-positions, respectively; a coupler component; and an acid stabilizer.

Two-component diazotype materials are known in the art which have a support provided with a light-sensitive layer comprising a diazonium compound, a coupler component, and an acid stabilizer. Upon exposure to actinic radiation, the diazonium compound is decomposed in the areas struck by light to form colorless compounds which are incapable of coupling. Developing of the two-component diazotype material is usually carried out with dry or moist ammonia gas. In the process, the acid stabilizer is neutralized and, simultaneously, the coupling reaction between the diazonium compound remaining in the areas not struck by light and the coupler component is initiated in these areas by a shift in pH in the light-sensitive layer.

It is also known that diazonium compounds derived from p-phenylenediamine and substituted in the 2- and 5-positions by ether groups have a high sensitivity to light in the spectral region at about 400 nm and are, in addition, particularly distinguished by their good stability and their coupling activity which is sufficient for many applications. These diazonium salts, moreover, couple with many coupler components to give strong and brilliant azo dyes of high optical density. Particularly suitable compounds are those which are substituted in the 4-position relative to the diazonium group by a heterocyclic radical, for example, a morpholino radical, and in the 2- and 5-positions by alkoxy groups having from 1 to 6 carbon atoms. These compounds are readily available, they couple, e.g., with blue components, to form strong azo dyes of a bright blue and a high visual density, and they undergo photolysis to form practically colorless decomposition products. Compounds of this kind include, for example, 4-N-morpholino-benzenediazonium salts which are substituted in the 2-and 5-positions by an alkoxy group having relatively long alkyl radicals, e.g., an n-propoxy, iso-propoxy, n-butoxy, iso-butoxy, n-amyloxy, iso-amyloxy, hexyloxy, or cyclohexyloxy group. Compared with the 2,5-disubstituted dimethoxy and diethoxy compounds, these compounds have the additional advantage of a higher thermal stability and a greater coupling activity. In addition, the color shades of blue coupling dyes are shifted from a reddish to a greenish blue, with an increasing number of carbon atoms in the alkoxy group. Greenish blue azo dyes, in combination with orange-colored and brown azo dyes, result in neutral black color shades and are, therefore, particularly suitable for black formulations.

The stability and the coupling activity of a diazonium compound are, however, not only influenced by the diazonium salt cation, but also by the diazonium salt anion. In conventional sensitizing preparations, the diazonium compounds are present in the form of salts of inorganic acids, for example, hydrochloric acid, sulfuric acid, phosphoric acid, fluoboric acid, hexafluorophosphoric acid, or in the form of diazonium chloride double salts with zinc chloride, cadmium chloride, and stannic chloride. Due to their good solubility in water, the sulfates and the zinc chloride double salts are especially suitable for aqueous sensitizing preparations. Diazonium tetrafluoroborates and diazonium hexafluorophosphates are particularly employed for organic sensitizing preparations. The most frequently used diazonium chlorides, diazonium hydrogen sulfates, diazonium tetrafluoroborates, and diazonium chloride double salts with zinc chloride and cadmium chloride have the disadvantage that their thermal stability is relatively low and their coupling activity is too great. A two-component diazotype material which contains these diazonium salts in its light-sensitive layer develops at sufficient speed in most commercial duplicators, but has a markedly reduced storability. Diazonium hexafluorophosphates, on the other hand, have a substantially higher thermal stability than the aforementioned diazonium salts and diazonium chloride double salts, but exhibit considerable disadvantages in their coupling activity. A two-component diazotype material containing these diazonium hexafluorophosphates has a very good storability, but a slow developing speed, so that the maximally attainable optical density of such a diazotype material is obtained only after repeated developing. An absence of easy developing is, however, not acceptable for conventional duplicating.

It is a disadvantage of many of the highly light-sensitive two-component diazotype materials which are presently used in practice that these materials have an inadequate storability or cannot be developed at sufficient speed in the high-performance duplicators. Storability and ease of developing are incompatible so that, in a two-component diazotype material which has a good storability, developability is, as a rule, worse than in a material which has a limited storability. Good storability is particularly necessary in those cases in which the requirement for copies is small or in which the material is stored under extreme climatic conditions, for example, in a damp and warm tropical climate.

SUMMARY OF THE INVENTION

It is, therefore, an object of the present invention to provide a highly light-sensitive two-component diazotype material, which has a good storability and which is, nevertheless, quickly processed without difficulty in commercial duplicators and yields copies of very high contrast, with a colorless image background. Ease of developing and storability of a two-component diazotype material are determined by the acid stabilizer in the light-sensitive layer and by the developing conditions and, in particular, by the coupling acitivity of the diazonium compound and the coupler component. The speed of coupling of a diazonium compound, in turn, is determined by the chemical constitution of the diazonium salt cation and the diazonium salt anion, respectively.

In accomplishing the aforementioned objects, there has been provided in accordance with the present invention a two-component diazotype material which comprises a support and at least one light-sensitive layer provided on the support, which layer contains (1) at least one diazonium compound derived from p-phenylenediamine and carrying a basic heterocyclic radical in the 4-position and ether groups in the 2- and 5-positions; (2) a coupler component; and (3) an acid stabilizer, wherein the diazonium compound comprises a benzenesulfonate or a toluenesulfonate. The toluenesulfonate used with the present invention particularly comprises p-toluene-sulfonate.

The two-component diazotype material provided in accordance with the present invention is highly light-sensitive and, irrespective of its great ease of developing, also possesses surprisingly excellent shelf life under dry or damp, warm climatic conditions. It develops into brillant dyes of high optical density and does not show any undesired discoloration of the exposed and developed background of the diazotype material, caused by the photolysis reaction of the diazonium salt cation and by the presence of the diazonium salt anion. A great ease of developing is particularly desirable in those cases in which the copy requirement is high and copies are produced at a very high duplicating speed and/or low development temperature.

U.S. Pat. No. 3,219,447 discloses diazonium salts of organic sulfonic acids which are soluble in organic solvents and which are used for the production of light-sensitive printing forms. For the separation of 4-N-morpholino-2,5-diethoxy and 4-N-morpholino-2,5-dibutoxy -benzenediazonium salts, alizarin-3-sulfonic acid is, however, mentioned. These salts are readily soluble in organic sensitizing preparations and insufficiently soluble in aqueous sensitizing preparations. Moreover, the exposed background of a material incorporating the disclosed benzenediazonium salts is yellow dyed; accordingly, it is impossible to use these compounds for the production of two-component diazotype materials.

U.S. Pat. No. 3,849,392 also mentions a great number of aromatic sulfonic acids for the separation of polycondensation products from specific diazonium compounds and methylene-active compounds. However, the diazo components used for these polycondensation products comprise compounds which are derived from diphenyl, diphenylamine, diphenylsulfide, diphenyloxide, and diphenyleneoxide compounds. These diazo-polycondensation products are, similarly, not used for the production of two-component diazotype materials.

It has been found that only the diazonium benzenesulfonates and diazonium toluenesulfonates are readily soluble both in aqueous and in organic sensitizing preparations and are, at the same time, also thermally stable. It was surprising that, e.g., 4-N-morpholino-2,5-dibutoxy-benzenediazonium-mesitylenesulfonate has a markedly lower thermal stability than, for example, the corresponding structurally homologous toluenesulfonate, which is used in accordance with the present invention. The diazonium salts of the same diazonium cation with naphthalene sulfonic acid, sulfosalicylic acid, and chlorinated benzene sulfonic acid are insufficiently soluble in aqueous sensitizing preparations. If naphthalene sulfonates are used in two-component diazotype materials, a discoloration of the exposed background is also observed with increasing storage time.

U.S. Pat. No. 3,522,048 discloses p-chlorobenzene sulfonates of diazonium salts which are substituted in the 4-position relative to the diazonium group by a heterocyclic basic radical and which are suitable for the production of heat-developable two-component diazotype materials adapted for high-speed processing. These compounds have a good thermal stability, but they do not dissolve to a sufficient degree in aqueous sensitizing preparations.

Futhermore, German Offenlegungsschrift No. 3,202,208 discloses diazonium compounds in the form of salts of sulfonic acids of aromatic monocarboxylic and dicarboxylic acids, which have the advantage of a high thermal stability, low inflammability, and improved storability of the diazotype materials prepared with these compounds. In spite of using additives which aid solvation, these diazonium salts do not have an entirely satisfactory solubility in the conventionally used aqueous and organic sensitizing preparations. It is thus possible to produce sensitizing preparations which have only a low diazo-concentration. This disadvantage leads to considerable problems with respect to coating technology.

In view of all this, it could by no means have been expected that, from the great number of diazonium salt anions in connection with the known diazonium salt cations, light sensitive layers are obtainable, in accordance with the present invention, which are readily soluble in organic and aqueous sensitizing solutions and which offer high sensitivity to light, good developability, and good storability.

Further objects, features, and advantages of the present invention will become apparent from the following detailed description of preferred embodiments and specific examples, which are given by way of illustration only.

DETAILED DESCRIPTION OF PREFERRED EMBODIMENTS

Suitable diazonium salt cations which are used in the present invention are those according to the formula:

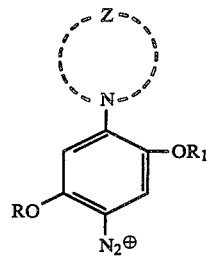

wherein

R and $R_1$ are identical or different and stand for alkyl, aralkyl, alkoxyalkyl, or cycloalkyl; and Z denotes, together with the nitrogen atom to which it is bonded, a heterocyclic 5- or 6-membered radical which may or may not contain an oxygen, a sulfur, and a nitrogen.

R and $R_1$ are preferably alkyl groups having from 2 to 6 carbon atoms, and as the heterocyclic radical optionally substituted morpholino, piperidino, piperazino, pyrrolidino, and thiomorpholino radicals are preferably employed.

Accordingly, the following benzenediazoniumtoluene and benzenediazonium-benzenesulfonates can, for example, be used in the present invention:

4-N-piperidino-2,5-diethoxy-benzenediazonium-p-toluene-sulfonate,

4-N-piperidino-2,5-dipropoxy-benzenediazonium-benzenesulfonate,

4-N-piperidino-2,5-dibutoxy-benzenediazonium-p-toluenesulfonate,

4-N-piperidino-2,5-di(iso)amyloxy-benzenediazonium-benzenesulfonate,

4-N-pyrrolidino-2,5-dipropoxy-benzenediazonium-p-toluenesulfonate,

4-N-pyrrolidino-2,5-dibutoxy-benzenediazonium-benzenesulfonate,
4-N-piperazino-2,5-di(iso)propoxy-benzenediazonium-p-toluenesulfonate,
4-N(4'-methyl)piperazino-2,5-dibutoxy-benzenediazonium-p-toluenesulfonate,
4-N(4'-N-acetyl)piperazino-2,5-dipropoxy-benzenediazonium-p-toluenesulfonate,
4-N-morpholino-2,5-di(iso)propoxy-benzenediazonium-p-toluenesulfonate,
4-N-morpholino-2,5-dibutoxy-benzenediazonium-p-toluenesulfonate,
4-N-morpholino-2,5-di(iso)butoxy-benzenediazonium-benzenesulfonate,
4-N-morpholino-2,5-dihexyloxy-benzenediazonium-benzenesulfonate,
4-N-morpholino-2,5-dicyclopentyloxy-benzenediazonium-benzenesulfonate,
4-N-morpholino-2,5-diethoxyethoxy-benzenediazonium-p-toluenesulfonate,
4-N-morpholino-2-methoxy-5-benzyloxy-benzenediazonium-benzenesulfonate,
4-N-thiomorpholino-2,5-dipropoxy-benzenediazonium-p-toluenesulfonate.

The diazonium salts are obtained as reaction products of benzenesulfonic acid, p-toluenesulfonic acid, or o-toluenesulfonic acid, or the alkali metal salts thereof, and a diazonium compound. The reaction is usually run in a weakly acidic aqueous solution. The resulting precipitate of the diazonium sulfonate is isolated by filtering-off and then is washed neutral with a saturated common salt solution. As the diazonium compounds which are used for reaction with the aromatic sulfonic acid, the diazonium chlorides, diazonium hydrogensulfates, or diazonium zincates which are readily soluble in water and are known for use in sensitizing preparations may be employed. In the preparation process, it is not necessary to isolate the diazonium salt as the chloride, hydrogensulfate, or zincate. According to the invention, it is also possible to use mixtures of diazonium compounds in which at least one compound comprises a benzenesulfonate or a toluenesulfonate. In these cases, the benzenesulfonate or toluenesulfonate is present in an amount of at least 75% by weight, based on diazonium compounds employed.

The aqueous diazonium salt solution obtained after the diazotization of the corresponding amino salt is sufficient as the reaction medium. Since it is possible to do without zinc and zinc salts in the preparation of the diazonium sulfonates, an expensive isolation and removal of zinc salts from production waste waters, which had to be carried out in previous, conventional diazo-production processes, can be dispensed with.

The diazonium salts of the present invention are highly light-sensitive and are photolytically decomposed, as are the known diazonium salts. They dissolve equally well in water and organic solvents and are, therefore, suitable for use in aqueous, organic, or aqueous/organic sensitizing preparations. Their stability is improved over that of the known diazonium chlorides, diazonium hydrogensulfates, diazonium tetrafluoroborates, and diazonium chloride double salts with zinc chloride, cadmium chloride and stannic chloride. They also attain the stability of the known diazonium hexafluorophosphates. Their coupling speed is in some cases higher than that of the known diazonium salts and diazonium chloride double salts, and is considerably higher than the coupling speed of the tetrafluoroborates and hexafluorophosphates.

Regardless of their great ease of developing, the two-component diazotype materials of the invention are also excellently storable, particularly under damp and warm climatic conditions. They develop into strong, brilliant color shades and do not show any undesired discoloration of the exposed and developed background of the diazotype material, caused by photolysis. The diazonium sulfonates and the two-component diazotype materials of the invention prepared with these diazonium sulfonates, respectively, compare favorably to the commercial diazonium salts of the same cation, and with the two-component diazotype materials prepared therewith, in all of the above-discussed characteristics: solubility, stability, ease of developing, and background of the diazotype material.

Sensitizing preparations used in the production of two-component diazotype materials can easily be prepared in accordance with the present invention. They contain diazonium sulfonates, the coupler component, and the acid stabilizers, and additionally also further additives which are conventionally used in diazo-coating preparations.

As the coupler components, the following compounds are exemplary of those suitable in the present invention: dihydroxynaphthalene, dihydroxynaphthalene monosulfonic and disulfonic acids and the amides and substituted amides thereof, $\alpha$- and $\beta$-hydroxynaphthoic acid amides and correspondingly substituted amides, resorcinol and its halogen and alkyl or alkoxy derivatives, resorcylic acids optionally substituted with halogen, resorcylic acid amides and substituted amides, compounds with active methylene groups such as acetoacetyl and cyanoacetyl derivatives, monohydroxy and polyhydroxy diphenyls, polyhydroxydiphenylsulfides, aminophenol derivatives, pyrazolone derivatives, and the like.

The additives which may be used in the diazocoating compositions of the present invention include known compounds, for example, acid stabilizers, e.g., citric acid, tartaric acid, boric acid, sulfosalicylic acid, p-toluene sulfonic acid, etc., or mixtures thereof; contrast-enhancing compounds, e.g., zinc chloride, aluminum sulfate or nickel sulfate; antioxidants, e.g., thiourea or thiourea derivatives; low-concentrated dyes, e.g., methyl violet, alizarin irisol, and the like, for stabilizing and improving the exposed background; developing accelerators, e.g., glycerol, glycerol monoacetate, glycerol diacetate and glycerol triacetate, urea and alkyl substituted ureas, etc.; finely divided or colloidal silicon dioxide or aluminum oxide and/or aqueous dispersions or colloidal solutions of organic film-forming binders, e.g., polyvinyl alcohol, hydroxyethyl cellulose, methyl cellulose, etc., and latex-type dispersions of polyvinyl acetate, polyvinyl chloride, polyvinyl chloride acetate, polyvinylidene chloride, polyacrylonitrile or polymethyl methylacrylate.

If plastic films are used as the diazotype-coating support, the diazo-coating composition is advantageously applied to the film surface from an organic medium which has a film-forming binder dissolved therein. Suitable film-forming binders include cellulose ethers, e.g., ethyl cellulose, cellulose esters, e.g., cellulose acetate, cellulose acetopropionate, cellulose butyrate and cellulose acetobutyrate; vinyl polymers, e.g., polyvinyl acetate, polyvinyl chloride, and polyvinylidene chloride, copolymers of vinyl acetate; poly-(methylmethacrylate)

copolymers, e.g., copolymers of alkyl acrylates and acrylic acid; and polyphenylene oxides or terpolymers of ethylene glycol, isophthalic acid, and terephthalic acid.

As the support for the two-component diazotype coating, any of the conventionally used opaque or transparent materials are suitable, for example, coated or uncoated opaque or transparent papers; cellulose esters, such as cellulose-2 ½-acetate and cellulose triacetate; polyesters, such as polyethylene terephthalate; vinyl polymers, such as polyvinyl acetate or polystyrene; and alkene polymers, such as polyethylene or polypropylene. The preferred support comprises a film of polyethylene terephthalate.

The two-component diazotype material of the present invention is processed in the usual manner, by imagewise exposure under a transparent original, using a light source which is rich in ultraviolet and short-wave visible radiation, for example, a high-pressure mercuryvapor lamp or a fluorescent lamp, and subsequent developing by means of moist or dry ammonia gas, at normal or raised temperature.

The following examples are intended to illustrate the invention in detail.

EXAMPLE 1

A coating solution of the composition specified below was divided into 6 portions of 100 g each (lacquer samples 1 to 6).

Cellulose acetopropionate: 41.5 g
acetone: 403.0 g
methanol: 104.0 g
ethylene glycol monomethyl ether: 24.0 g
n-butanol: 24.0 g
5-sulfosalicylic acid: 0.27 g
2,3-dihydroxynaphthalene-6-sulfonic acid-N(4'-chlorophenyl)-amide: 3.24 g Each of these six lacquer samples was sensitized with $1.88\times10^{-3}$ mole of the following diazonium salts:

1. 0.95 g of 4-N-morpholino-2,5-dibutoxy-benzenediazonium-p-toluenesulfonate (molecular weight (MW): 505)
2. 0.92 g of 4-N-morpholino-2,5-dibutoxy-benzenediazonium-benzenesulfonate (MW: 491)
3. 0.79 g of 4-N-morpholino-2,5-dibutoxy-benzenediazonium-tetrafluoroborate (MW: 421)
4. 0.82 g of 4-N-morpholino-2,5-dibutoxy-benzenediazoniumchloride ($ZnCl_2$ double salt) (MW: 438)
5. 0.81 g 4-N-morpholino-2,5-dibutoxy-benzenediazonium-hydrogensulfonate (MW: 431)
6. 0.90 g 4-N-morpholino-2,5-dibutoxy-benzenediazonium-hexafluorophosphate (MW: 479)

Each lacquer sample was applied to a 125 μm thick glass-clear polyethylene terephthalate film provided with a conventional adhesive coating, with the aid of a 10 cm wide coating knife having a gap width of 0.16 mm. Each sample was then dried for 1 minute in a circulating-air drying oven at 90° C., and the diazo film samples thus obtained were numbered in accordance with lacquer samples 1 to 6. The coating weight of each film sample was 6.8 g/m².

For a comparative examination of stability, a section of each film sample was exposed under a grid original such that the transparent regions were completely exposed. Developing was then carried out with moist ammonia gas and resulted in the minimal density ($D_{min}$) in the exposed film regions and the maximally attainable full-tone density ($D_{max}$) in the non-exposed film regions. The difference $D_{max}-D_{min}$ gave the image contrast of the processed film sample.

Another section of each film sample was stored for 7 days at 50° C. and 60% relative humidity (film samples 1a to 6a). After this storage time, the film samples were exposed and developed, as described above for reference samples 1 to 6. The full-tone and background densities thus obtained were measured and the loss in contrast of the stored film sample was determined in comparison with the corresponding reference sample.

Optical densities were measured with the aid of a Macbeth-Quantalog-Densitometer TD 205 and a Kodak Wratten-Filter No. 106. The results obtained are compiled in Table 1.

TABLE 1

| Film Sample | Optical Density $D_{max}$ | Optical Density $D_{min}$ | Contrast $D_{max}$ | Contrast $D_{min}$ | Background |
|---|---|---|---|---|---|
| 1 | 1.70 | 0.04 | 1.66 | | colorless |
| 1a | 1.22 | 0.11 | 1.11 | (67%) | almost colorless |
| 2 | 1.75 | 0.04 | 1.71 | | colorless |
| 2a | 1.23 | 0.10 | 1.13 | (66%) | almost colorless |
| 3 | 1.52 | 0.04 | 1.48 | | colorless |
| 3a | 0.98 | 0.34 | 0.64 | (43%) | blue |
| 4 | 1.69 | 0.04 | 1.65 | | colorless |
| 4a | 1.03 | 0.22 | 0.81 | (49%) | weakly blue |
| 5 | 1.77 | 0.04 | 1.73 | | colorless |
| 5a | 1.08 | 0.30 | 0.78 | (45%) | blue |
| 6 | 1.78 | 0.04 | 1.74 | | colorless |
| 6a | 1.20 | 0.07 | 1.13 | (63%) | colorless |

Upon exposure and developing, a positive film copy of the grid original was obtained, which had blue lines on a colorless transparent film background. After the forced storage at 50° C. and 60% relative humidity, film samples 1a, 2a, and 6a showed the least loss in contrast, film samples 4a and 5a a considerably higher loss, and the film sample 3a the greatest loss in contrast.

To determine the relative speed of developing, two additional film samples were prepared from each coating solution 1 to 6. One film sample was, in each case, developed three times in a commercial duplicator at a speed of travel of 0.5 m/min, to give the maximally attainable full-tone density ($D_{max}$). The second film sample carrying the same coating was, in each case, developed once at a speed of travel of 4 m/min, and the optical density ($D_K$) obtained was measured.

A comparison between the optical density ($D_K$) achieved at a speed of travel of 4 m/min and the maximally attainable full-tone density ($D_{max}$) is a measure of the ease of developing offered by the film sample.

The results obtained are compiled in Table 2.

TABLE 2

| Film Sample | $D_{max}$ | $D_K$ | $D_R$ |
|---|---|---|---|
| 1 | 1.74 | 1.74 | 100% |
| 2 | 1.75 | 1.75 | 100% |
| 3 | 1.53 | 1.37 | 90% |
| 4 | 1.72 | 1.72 | 100% |
| 5 | 1.74 | 1.74 | 100% |
| 6 | 1.86 | 1.55 | 83% |

The values of the relative optical densities ($D_R$) show that film samples 1, 2, 4, and 5 possess the greatest ease of developing, film sample 3 a reduced ease of developing, and film sample 6 the least ease of developing.

Solubility tests were carried out to determine the solubility in water of the diazonium toluenesulfonates according to the invention and of the diazonium sulfonates which are attainable using some of the aromatic sulfonic acids mentioned in U.S. Pat. Nos. 3,219,447, 3,849,392 and 3,522,048 and in German Offenlegungsschrift Pat. No. 3,202,208. The diazonium salts investigated differed only in their diazonium salt anion.

The following aromatic sulfonic acids were used to prepare 4-N-morpholino-2,5-dibutoxy-benzenediazonium-sulfonates (TABLE 3). The solubility of the 4-N-morpholino -2,5-dibutoxy-benzenediazonium-sulfonates was determined in water at 23.C.

TABLE 3

| Acid of the Diazoniumsulfonate Anion | Solubility (%) |
|---|---|
| 1. Benzene-sulfonic acid | 3.3 |
| 2. p-toluene-sulfonic acid | 2.7 |
| 3. 4-chlorobenzene-sulfonic acid | 0.3 |
| 4. alizarin-3-sulfonic acid | 0.2 |
| 5. 1-chloronaphthalene-4-sulfonic acid | 0.2 |
| 6. 2-nitro-1-methylbenzene-4-sulfonic acid | 0.3 |
| 7. diphenylamine-4-sulfonic acid | 0.2 |
| 8. anthracene-1-sulfonic acid | 0.2 |
| 9. iso-phthalic acid-5-sulfonic acid | 0.35 |

The solubility in water of diazonium sulfonates 1 and 2 according to the present invention is better than that of diazonium sulfonates 3 to 9, by a factor of about 10 to 20. In organic solvents, diazonium sulfonates 1 to 8 dissolved well, while diazonium sulfonate 9 was noticeably less soluble.

A comparison of the sum of results of (a) solubility of the diazonium salts in water and organic solvents and (b) stability and ease of developing of the two-component diazotype materials produced with these diazonium salts, clearly shows the advantage of the diazonium benzenesulfonates and diazonium toluenesulfonates of the present invention over the commercial diazonium hydrogensulfates, diazonium tetrafluoroborates, diazonium hexafluorophosphates, and diazonium zinc chloride double salts and the diazonium sulfonates prepared according to U.S. Pat. Nos. 3,219,447, 3,849,392, and 3,522,048, and according to German Offenlegungsschrift Pat. No. 3,202,208.

The diazonium benzenesulfonates and diazonium toluenesulfonates of this invention can be used both for the production of aqueous and also of organic sensitizing preparations, and they yield highly light-sensitive two-component diazotype materials which develop very quickly and have, nevertheless, a good storability.

EXAMPLE 2

A 125 μum thick polyethylene terephthalate film provided with a conventional adhesive coating was coated on its subbed surface with a solution of the following composition:

Acetone: 67.5 g
methanol: 17.5 g
ethylene glycol monomethyl ether: 4.0 g
n-butanol: 4.0 g
cellulose acetopropionate: 7.0 g
5-sulfosalicyclic acid: 0.43 g
N,N'-dimethylurea: 0.12 g
glyceroltriacetate: 0.24 g
2-methylresorcinol: 0.26 g
2,3-dihydroxynaphthalene-6-sulfonic acid N(4'-chlorophenyl)-amide: 0.16 g
6-methoxy-2-hydroxy-3-naphthoic acid -N(3'-morpholinopropyl)-amide: 0.37 g
2,2',4,4'-tetrahydroxy-diphenylsulfide 0.05 g
4-N-morpholino-2,5-dibutoxy-benzene-diazonium-p-toluenesulfonate: 1.25 g
4-N-diethylamino-benzenediazonium-chloride ($ZnCl_2$ double salt) 0.14 g The solids content was 9.7% by weight. The coating was applied with the aid of a 10 cm wide coating knife having a gap width of 0.16 mm and was then dried in a circulating-air drying oven at 90° C. Layer weight: 7.1 g/m$^2$. A section of the film sample thus prepared was exposed under a grid original, as described in Example 1, and was then developed and the visual contrast determined (Sample A).

A second section of the unprocessed film sample was stored for 7 days at 50° C. and 60% relative humidity and was thereafter also exposed under a grid original, developed, and then used to determine contrast (Sample B).

The loss in contrast of the stored film Sample B was only very slight, as compared to the reference film Sample A, and was practically hardly noticeable.

If the 4-N-morpholino-2,5-dibutoxy-benzene-diazonium-p-toluene-sulfonate used in the specified sensitizing solution is replaced by the equimolecular quantity of 1.04 g of 4-N-morpholino-2,5-dibutoxy-benzenediazonium-tetrafluoborate, a diazo film sample (Sample C) is obtained which, after storage for 7 days at 50° C. and 60% relative humidity, exhibits a clear decrease in contrast (pre-coupling), as compared to Sample B.

A comparison of the speeds of developing of the two samples shows that the sample containing 4-N-morpholino -2,5-dibutoxy-benzenediazonium-p-toluenesulfonate develops faster than reference Sample C containing 4-N-morpholino-2,5-dibutoxy-benzenediazonium-tetrafluoroborate.

Owing to its good storability and, at the same time, great ease of developing, the sample which comprises the diazonium p-toluenesulfonate of the invention is favorably distinguished from the sample containing the commercial diazonium tetrafluoroborate.

EXAMPLE 3

A base paper, as conventionally used in diazo printing, which was provided with a precoating of silicic acid and polyvinyl acetate on one side thereof, was coated on the subbed surface with an aqueous solution having the following composition:

Water: 100 ml
citric acid: 4.0 g
thiourea: 4.0 g
saponin: 0.02 g
2-hydroxy-3-naphthoic acid-N(3'morpholinopropyl)-amide (HCl salt): 1.0 g
4-N-morpholino-2,5-dibutoxy-benzene-diazonium-p-toluenesulfonate: 1.31 g After drying, the sensitized paper was exposed under a transparent original and then developed with ammonia. A copy of the original was obtained that showed a very high contrast and had strong deep-blue lines on a white background. The same result was obtained when the 4-N-morpholino-2,5-dibutoxy-benzenediazonium-p-toluenesulfonate was replaced by the equimolecular quantity of 1.28 g of 4-N-morpholino-2,5-dibutoxy-benzenediazonium-benzenesulfonate.

If, on the other hand, an equimolecular quantity by weight of the commercial 4-N-morpholino-2,5-dibutoxy-benzenediazonium-tetrafluoroborate is used instead of 4-N-morpholino-2,5-dibutoxy-benzenediazonium-p-toluenesulfonate, a copy of the original is obtained that shows clearly reduced contrast and has light-blue lines on a white background.

What is claimed is:

1. A two-component diazotype material, comprising a support and at least one light-sensitive layer provided on said support, said layer consisting essentially of, in admixture, (i) a first amount of at least one light-sensitive diazonium compound derived from p-phenylenediamine and carrying a basic heterocyclic radical in the 4-position and ether groups in the 2- and 5-positions, said first amount being sufficient to impart photosensitivity to said layer; (ii) a second amount of a coupler component, said second amount being sufficient to permit initiation of a coupling reaction with said diazonium compound when said diazotype material is exposed; and (iii) an acid stabilizer, said diazonium compound comprising an anion selected from the group consisting of a benzenesulfonate and a p-toluene-sulfonate.

2. A diazotype material as claimed in claim 1, wherein said diazonium compound comprises a cation of the formula

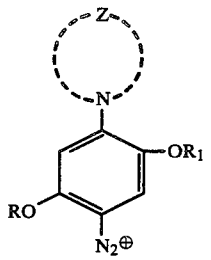

wherein R and $R_1$ are identical or different and stand for alkyl, aralkyl, alkoxyalkyl, or cycloalkyl; and Z denotes, together with the nitrogen atom to which it is bonded, a heterocyclic 5- or 6-membered radical which may or may not contain an oxygen, a sulfur, and a nitrogen.

3. A diazotype material as claimed in claim 2, wherein R and $R_1$ both separately denote an alkyl group having from 2 to 6 carbon atoms.

4. A diazotype material as claimed in claim 2, wherein said heterocyclic radical is substituted or unsubstituted and is selected from the group consisting of a morpholino radical, a piperidino radical, a piperazino radical, a pyrrolidino radical, and a thiomorpholino radical.

5. A diazotype material as claimed in claim 1, wherein the diazonium compound comprises 4-N-morpholino-2,5-di(n)butoxy-benzenediazonium-p-toluenesulfonate.

6. A diazotype material as claimed in claim 1, wherein the diazonium compound comprises 4-N-morpholino-2,5-di(n)butoxy-benzenediazonium-benzenesulfonate.

7. A diazotype material as claimed in claim 1, wherein the diazonium compound comprises a mixture of diazonium salts, said mixture comprising at least one diazonium salt in the form of a benzenesulfonate or p-toluenesulfonate.

8. A diazotype material as claimed in claim 7, wherein said benzenesulfonate or p-toluenesulfonate is present in an amount of at least 75 percent by weight, based on the diazonium compounds used.

9. A diazotype material as claimed in claim 1, wherein the support comprises a transparent plastic film.

10. A diazotype material as claimed in claim 9, wherein the support comprises a film of polyethylene-terephthalate.

* * * * *